US012336614B2

(12) United States Patent
Chabrerie et al.

(10) Patent No.: US 12,336,614 B2
(45) Date of Patent: Jun. 24, 2025

(54) REFILLABLE APPLICATOR FOR COSMETICS

(71) Applicant: COSMOGEN SAS, Paris (FR)

(72) Inventors: Hugues Chabrerie, Issy-les-Moulineaux (FR); Christophe Benigni, Pantin (FR)

(73) Assignee: COSMOGEN SAS, Paris (FR)

( * ) Notice: Subject to any disclaimer, the term of this patent is extended or adjusted under 35 U.S.C. 154(b) by 106 days.

(21) Appl. No.: 18/312,994

(22) Filed: May 5, 2023

(65) Prior Publication Data

US 2023/0309680 A1 Oct. 5, 2023

Related U.S. Application Data

(63) Continuation of application No. PCT/FR2021/051904, filed on Oct. 28, 2021.

(30) Foreign Application Priority Data

Nov. 6, 2020 (FR) ..... 20/11448

(51) Int. Cl.
*A45D 40/02* (2006.01)
*A45D 40/00* (2006.01)
*A45D 40/20* (2006.01)

(52) U.S. Cl.
CPC .... *A45D 40/023* (2013.01); *A45D 2040/0031* (2013.01); *A45D 2040/0043* (2013.01); *A45D 2040/005* (2013.01); *A45D 2040/204* (2013.01)

(58) Field of Classification Search
CPC ..... A45D 40/023; A45D 2040/0031; A45D 40/00; A45D 2040/0006; A45D 2040/0018; A45D 2040/0043; A45D 2040/005; A45D 2040/204; A45D 40/14; A45D 40/16
USPC ..... 401/75–78; 200/302.1, 302.2
See application file for complete search history.

(56) References Cited

U.S. PATENT DOCUMENTS 5,413,358 A * 5/1995 Austin, Jr. ..... H01H 13/06 277/648
5,420,386 A * 5/1995 Reinelt ..... H01H 13/06 277/549
6,483,057 B1 * 11/2002 Wu ..... H01H 13/06 200/341
11,910,909 B2 * 2/2024 Delbove ..... A45D 40/10
(Continued)

FOREIGN PATENT DOCUMENTS

| | | |
|---|---|---|
| GB | 853306 | 11/1960 |
| WO | 2007064723 | 6/2007 |
| WO | 2012131320 | 10/2012 |

OTHER PUBLICATIONS

International Search Report issued in corresponding International Application PCT/FR2021/051904, mailed Mar. 2, 2022.

*Primary Examiner* — David J Walczak
(74) *Attorney, Agent, or Firm* — Burris Law, PLLC

(57) ABSTRACT

A refillable applicator for a cosmetic product includes a cartridge that is movable between an initial position and an ejected position. The applicator includes a case housing the cartridge, and a push button designed to eject the cartridge, the push button being movable between an idle position wherein it is designed to enable the cartridge to be in the initial position in the case, and an ejection position wherein it is designed to eject the cartridge from the case.

20 Claims, 4 Drawing Sheets

(56) References Cited

U.S. PATENT DOCUMENTS

| | | | | |
|---|---|---|---|---|
| 2010/0209172 | A1* | 8/2010 | Drugeon | B65D 83/384<br>401/55 |
| 2021/0085058 | A1* | 3/2021 | Oh | A45D 40/06 |

* cited by examiner

REFILLABLE APPLICATOR FOR COSMETICS

CROSS-REFERENCE TO RELATED APPLICATIONS

This application is a continuation of International Application No. PCT/FR2021/051904, filed on Oct. 28, 2021, which claims priority to and the benefit of FR 20/11448, filed on Nov. 6, 2020. The disclosures of the above applications are incorporated herein by reference in their entireties.

FIELD

The present disclosure relates to the field of refillable applicators for cosmetics, such as refillable lipsticks or deodorants.

BACKGROUND

The statements in this section merely provide background information related to the present disclosure and may not constitute prior art.

Usually, refillable applicators include a cartridge configured to trap a cosmetic product. This cartridge is generally disposed in a case and can be ejected manually by a user, so that it can be replaced by another cartridge. The ejection of such cartridges is for example carried out by a user, by applying an axial translational force to the cartridge, upwards or downwards, relative to the case. As a variant, the ejection of such cartridges may be carried out by applying an axial rotational and translational force to the cartridge, upwards or downwards, relative to the case.

A drawback of this type of system is that it may be difficult to eject the cartridge. In addition, the user must directly handle the cartridge in order to eject it and may therefore be in contact with the cosmetic product which could stain for example.

The present disclosure addresses these and other concerns relating to refillable applicators for cosmetics.

SUMMARY

This section provides a general summary of the disclosure and is not a comprehensive disclosure of its full scope or all of its features.

A refillable applicator for a cosmetic product is configured to include a cartridge movable between an initial position and an ejected position, the applicator including:

- a housing case for the cartridge, and
- a push button configured to eject the cartridge, the push button being movable between a rest position in which it is configured to allow the cartridge to be in the initial position in the case, and an ejection position in which it is configured to eject the cartridge from the case.

A cosmetic product means any product intended to be brought into contact with parts of the human body with a view to cleaning them, perfuming them, modifying their appearance, protecting them, keeping them in good condition or correcting body odors, and more particularly solid products.

In the initial position, the cartridge is configured to be disposed in the case, and in the ejected position the cartridge is configured to be disposed at least partially outside the case.

Thus, the refillable applicator according to the present disclosure makes it possible to eject the cartridge in order to replace it, in a simple manner by limiting contact with the cartridge and therefore with the cosmetic product.

The cartridge is configured to include the cosmetic product. It may also be called a refill.

According to variations of the present disclosure, the applicator includes one or several of the following optional features, considered alone or in all possible combinations.

According to one characteristic, the applicator includes sealing means between the push button and the case, when the push button is in the rest position and/or when the push button is in the ejection position. Thus, the push button cooperates with the case in a sealed manner, to provide the ejection of the cartridge.

In this way, the sealing of the applicator is provided. Indeed, the applicator is sealed so that no liquid or gas may alter the cosmetic product disposed in the cartridge.

According to one characteristic, the push button comprises sealing means between the push button and the case.

According to one characteristic, the sealing means between the push button and the case includes at least one boss disposed on the push button and clampingly bearing against the case, and in one variant several bosses.

According to one characteristic, the sealing means between the push button and the case includes an overmolded part on the push button, for example made of elastomeric thermoplastic material, clampingly bearing against the case.

According to one characteristic, the overmolded part includes at least one boss, and in one form several bosses.

According to one characteristic, the applicator has a longitudinal central axis, and the case comprises an axial tab directed towards the longitudinal central axis, the axial tab being configured to cooperate with the sealing means between the push button and the case.

According to one characteristic, the case comprises the sealing means between the push button and the case.

According to one characteristic, the applicator has a longitudinal central axis, and the case comprises an axial tab directed towards the longitudinal central axis, the axial tab comprising the sealing means between the push button and the case.

According to one characteristic, the sealing means between the push button and the case includes at least one boss disposed on the case and clampingly bearing against the push button, and in one form several bosses.

According to one characteristic, the sealing means between the push button and the case includes an overmolded part on the case, for example made of elastomeric thermoplastic material, including at least one boss clampingly bearing against the push button, and in one form several bosses.

According to one characteristic, the sealing means between the push button and the case comprises an O-ring disposed between the case and the push button.

According to one characteristic, the applicator includes a cartridge movable between an initial position in which the cartridge is fastened to the case, and an ejected position in which the cartridge is detached from the case.

Thus, the push button is configured to detach the cartridge from the case when it is in the ejection position, in order to provide the ejection of the cartridge out from the case.

According to one characteristic, the cartridge comprises clipping means configured to fasten the cartridge to the case.

According to this characteristic, the push button is configured to unclip the cartridge from the case when it is in the ejection position.

According to one characteristic, the axial tab of the case includes a cavity and the clipping means of the cartridge comprise a protrusion configured to cooperate with the cavity of the axial tab of the case, so as to retain the cartridge in the case.

According to one characteristic, the case is made of plastic material. Thus, the case has a certain flexibility.

According to one characteristic, the cartridge comprises:

A ring having a recess configured to comprise a cosmetic product,

A cup movable in axial translation in the recess in order to bring the cosmetic product out of the recess or to bring the cosmetic product into the recess, the cup having a stem with a thread pitch, and An insert comprising the clipping means, the insert having a thread pitch complementary to the thread pitch of the stem of the cup, the ring being movable in rotation relative to the case and cooperating with the cup in order to drive it in axial translation.

More particularly, the ring is configured to drive the cup in rotation, and the cup cooperates with the insert, thanks to the complementary thread pitches, so as to be driven in axial translation.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
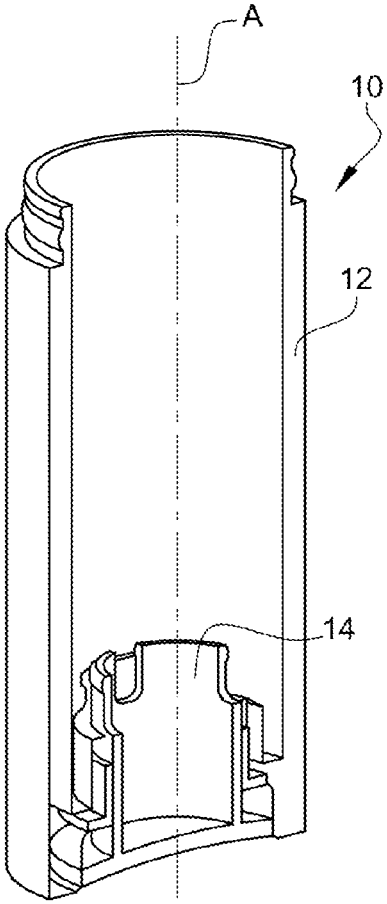
FIG. 1 is a partial cross-sectional schematic view of a refillable applicator according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following description and in the claims, identical, similar or analogous components will be designated by the same reference numerals in order to facilitate the description.

FIG. 1 represents a refillable applicator 10 for a cosmetic product, according to one form of the present disclosure.

Figure 6:
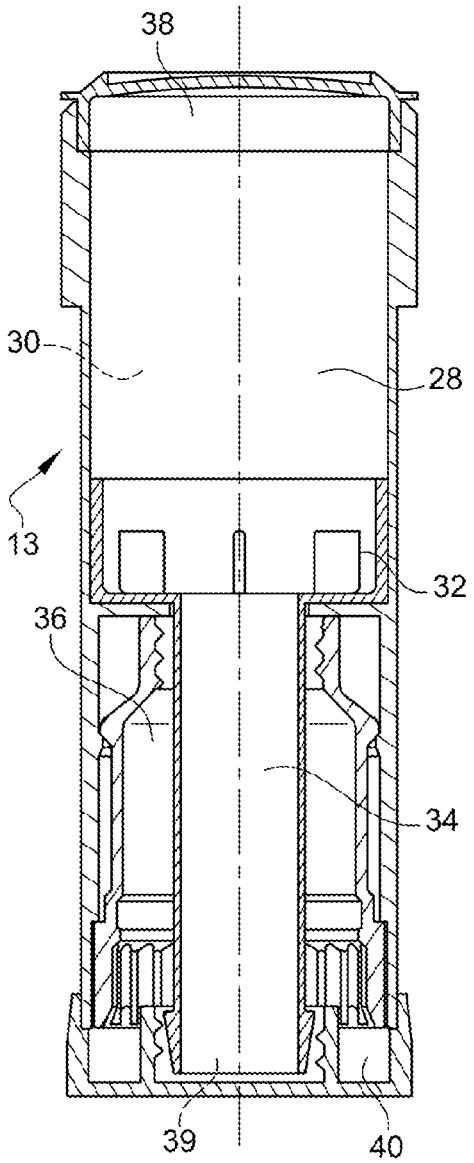
FIG. 6 is a partial cross-sectional schematic view of the cartridge of the applicator of FIG. 2.

The refillable applicator 10 is configured to include a cartridge 13 (FIG. 6). The applicator 10 includes a housing case 12 for the cartridge, and a push button 14 configured to eject the cartridge.

The push button 14 is movable between a rest position (FIG. 4), in which it is configured to allow the cartridge 13 to be fastened to the case 12, and an ejection position (FIG. 5) in which it is configured to eject the cartridge 13 out of the case 12.

The case 12 is advantageously configured to cooperate with the push button 14 in a sealed manner, to allow the ejection of the cartridge 13.

The applicator 10 may include sealing means 18 between the push button 14 and the case 12. The sealing means 18 provides sealed cooperation between the case 12 and the push button 14. In this way, the sealing of the applicator 10 is provided. The sealing means are described in more detail with regard to FIG. 3 which corresponds to a detailed view of the sealing area III of FIG. 2.

Figure 4:
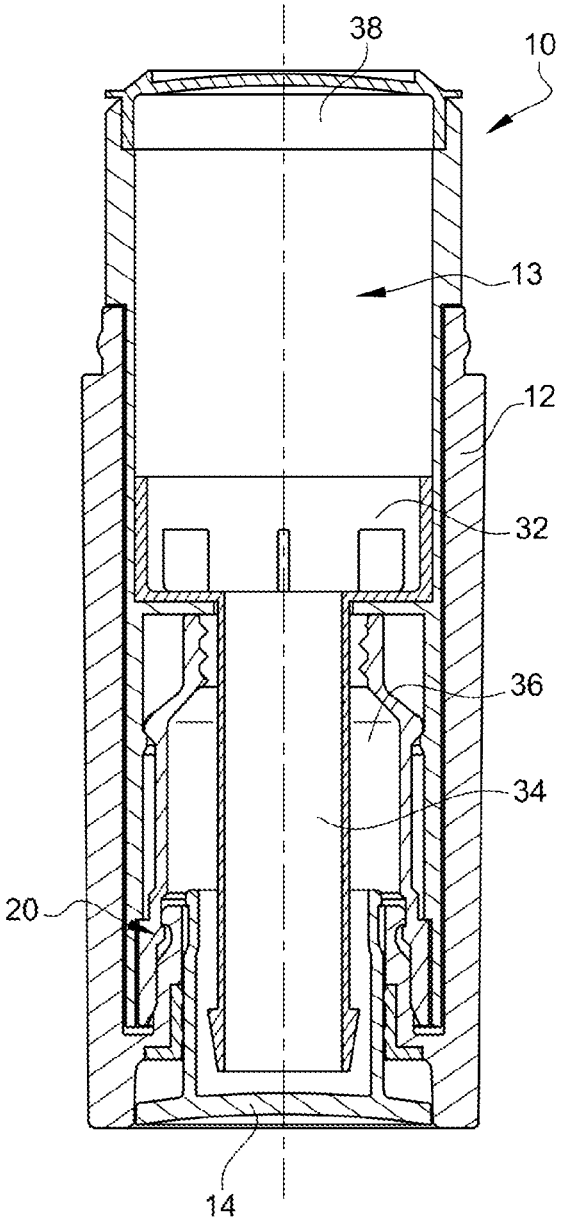
FIG. 4 is a partial cross-sectional schematic view of the applicator of FIG. 2, the cartridge being in the initial position.
Figure 2:
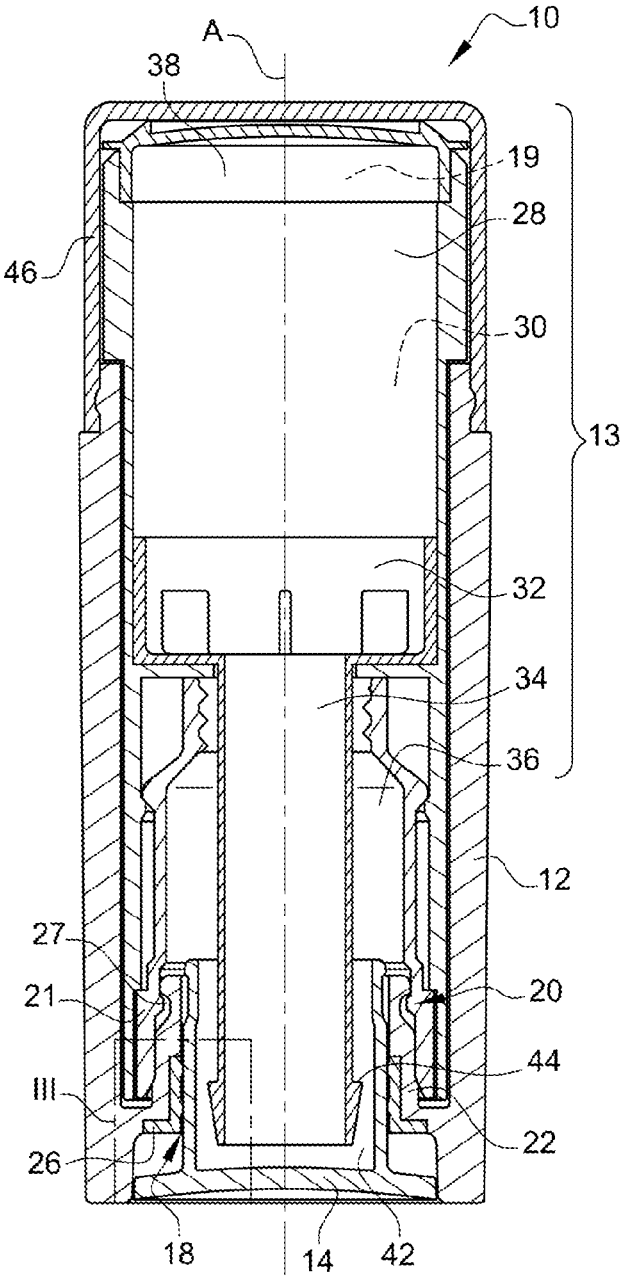
FIG. 2 is a partial cross-sectional schematic view of the refillable applicator of FIG. 1, including a cartridge and a cover.
Figure 5:
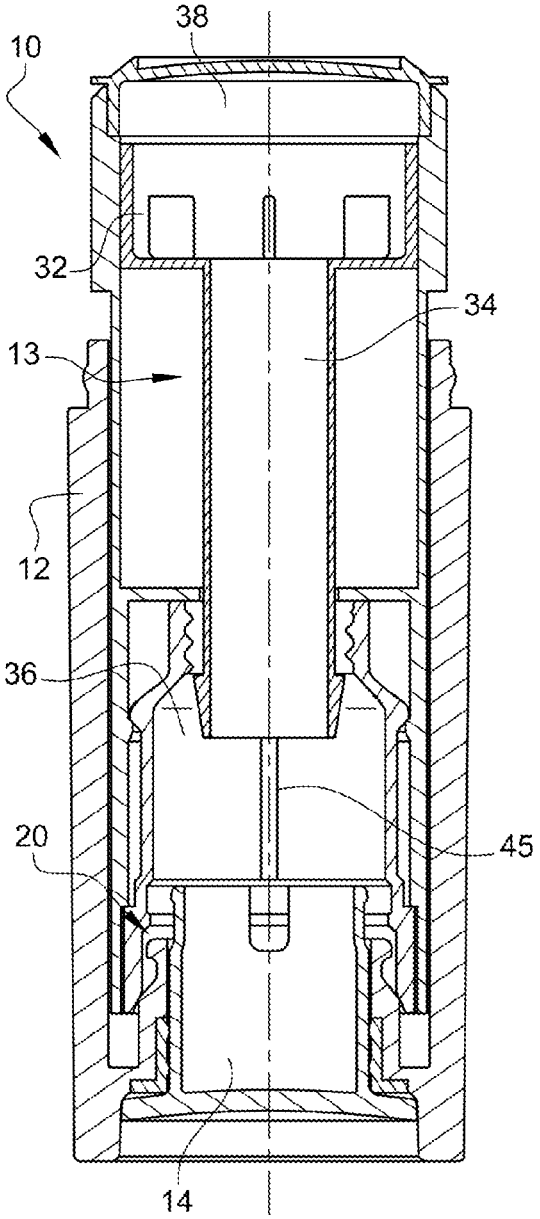
FIG. 5 is a partial cross-sectional schematic view of the applicator of FIG. 2, the cartridge being in the ejected position.

As shown in FIGS. 2, 4 and 5, the applicator 10 may include a cartridge 13 movable between an initial position (FIG. 4) in which the cartridge 13 is fastened to the case 12, and an ejected position (FIG. 5) in which the cartridge 13 is detached from the case 12. Thus, the push button 14 is configured to detach the cartridge 13 from the case 12 when it is in the ejection position, in order to allow the ejection of the cartridge 13 out of the case 12.

In the initial position, the cartridge 13 is configured to be disposed in the case 12, and, in the ejected position, the cartridge 13 is configured to be disposed at least partially outside the case 12.

The cartridge 13 is configured to include a product such as a cosmetic product or a care product, in some variations a solid. It may also be called a refill.

Figure 3:
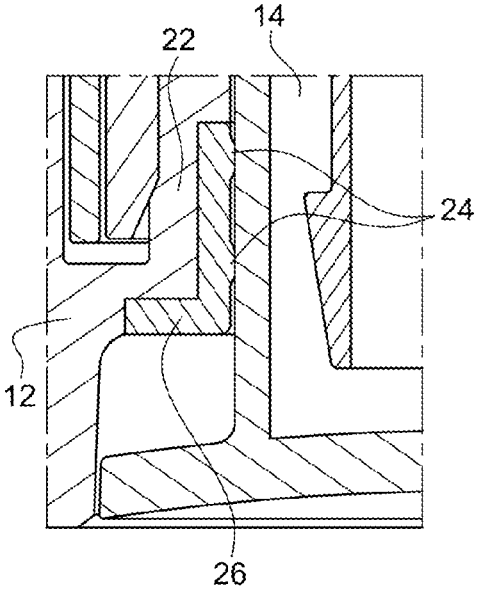
FIG. 3 is a partial cross-sectional schematic view of a sealing area of the applicator of FIG. 2.

As shown more particularly by FIG. 3, the sealing means 18 between the push button 14 and the case 12 may include a boss 24 disposed on the case 12 and clampingly bearing against the push button 14.

The sealing means 18 between the push button 14 and the case 12 may include several bosses 24 disposed on the case 12 and clampingly bearing against the push button 14. By way of example, the sealing means 18 between the button pusher 14 and the case 12 may include two bosses 24 disposed on the case 12 and clampingly bearing against the push button 14.

The sealing means 18 between the push button 14 and the case 12 may include an overmolded part 26 on the case 12, for example made of elastomeric thermoplastic material, including a boss 24 clampingly bearing against the push button 14.

As a variant, the overmolded part 26 may include several bosses 24 clampingly bearing against the push button 14. By way of example, the overmolded part 26 may include two bosses 24 clampingly bearing against the push button 14.

In a variant not shown, the sealing means 18 between the push button 14 and the case 12 may comprise an O-ring disposed between the case 12 and the push button 14.

The applicator 10 may have a longitudinal central axis A.

In addition, the case 12 may comprise an axial tab 22 directed towards the longitudinal central axis A. The axial tab 22 may comprise the sealing means 18 between the push button 14 and the case 12.

The axial tab 22 may comprise the boss(es) 24 clampingly bearing against the push button 14.

The axial tab 22 may comprise the overmolded part 26.

The O-ring, not shown, may be disposed between the axial tab 22 of the case 12 and the push button 14.

FIG. 6 illustrates the cartridge 13 of the applicator 10 of FIGS. 2, 4 and 5.

The cartridge 13 includes an output port 19 through which the cosmetic product is configured to exit.

The cartridge 13 may include clipping means 20 making it possible to fasten the cartridge 13 to the case 12. The push button 14 is configured to unclip the cartridge 13 from the case 12 when it is in the ejection position.

The clipping means 20 may cooperate with the axial tab 22 of the case 12 to retain the cartridge 13 in the case 12.

The axial tab 22 of the case 12 may include a cavity 27, and the clipping means 20 of the cartridge 13 may include a protrusion 21 configured to cooperate with the cavity 27 of the axial tab 22 of the case 12, so as to retain the cartridge 13 in the case 12.

The cartridge 13 may comprise:

- a ring 28 having a recess 30 configured to comprise a cosmetic product,
- a cup 32 movable in axial translation in the recess 30 in order to bring the cosmetic product out of the recess or to bring the cosmetic product into the recess, the cup having a stem 34 with a thread pitch, and An insert 36 comprising the clipping means 20 so as to be secured to the case 12 when the cartridge 13 is in the initial position, the insert 36 having a thread pitch complementary to the thread pitch of the stem 34 of the cup 32.

The ring 28 may be movable in rotation relative to the case 12 and cooperate with the cup 32 in order to drive it in axial translation, as shown in FIGS. 4 and 5.

The case 12 may be made of plastic material. Thus, the case has a certain flexibility.

The cartridge may comprise a plug 38 configured to close the output port 19 of the cosmetic product.

Additionally, the cartridge may comprise a port 39 opposite to the output port 19, and a shutter 40 configured to close the opposite port 39.

The cosmetic product may be liquid-cast into the recess 30 of the ring 28 either through the output port 19 or through the opposite port 39. The cosmetic product is then configured to solidify.

The push button 14 may comprise a housing 42 in which the stem 34 of the cup 32 is configured to be housed. The stem 34 of the cup is free in axial translation in the housing 42.

The cup 32 may include an annular hook 44 configured to cooperate with the ring 28 in order to retain the cup 32 in the cartridge 13, when the cartridge is in the ejection position.

As shown in FIGS. 4 and 5, when the cartridge 13 is ejected, the push button 14 pushes the insert 36 so as to release the clipping means 20. In this way, the cartridge 13 is ejected from the case 12.

The insert 36 may include at least one longitudinal rib 45 configured to cooperate with the push button 14 in order to push the insert 36 so as to release the clipping means 20. The insert 36 may include several longitudinal ribs 45. The push button 14 may rest against the rib(s) 45.

In a variant not shown, the applicator 10 may include an application head fastened to the case 12 opposite the push button. The application head may for example include a brush or a metallic element.

In addition, the applicator 10 may include a cover 46 configured to cooperate with the case 12 in order to close the applicator 10, in a sealed manner.

The applicator may be tubular.

Figure 7:
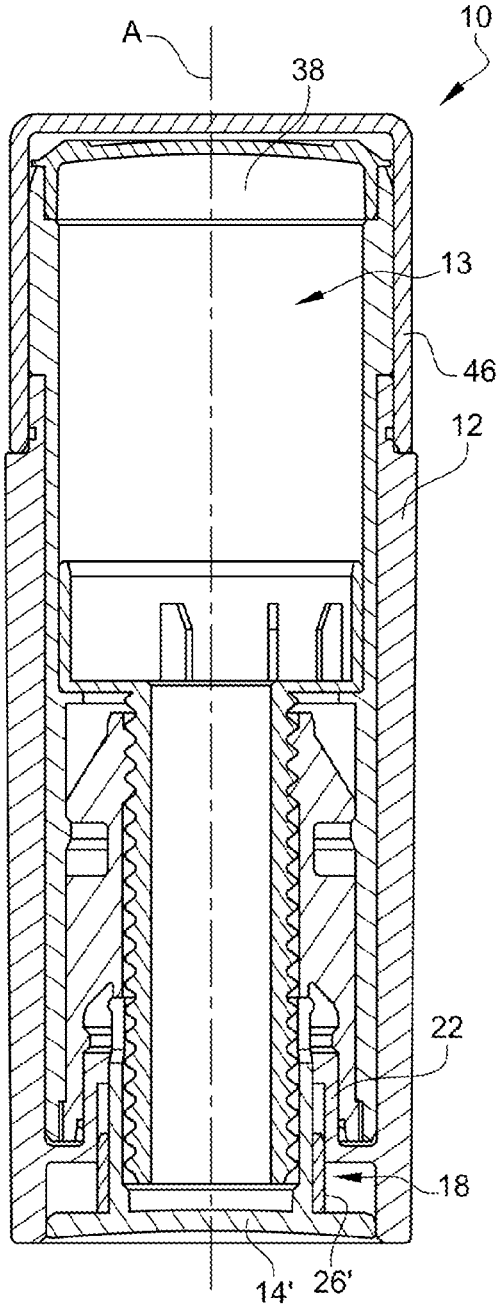
FIG. 7 is a partial cross-sectional schematic view of a refillable applicator according to another form of the present disclosure.
Figure 8:
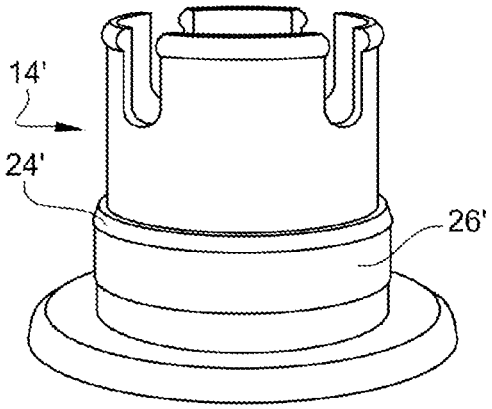
FIG. 8 is a schematic view of the push button of the applicator of FIG. 7.

FIG. 7 represents a refillable applicator 10 for a cosmetic product, according to another form of the present disclosure. The applicator 10 is configured to include a cartridge 13 as described previously. It includes a housing case 12 for the cartridge 13, and a push button 14' (FIG. 8) configured to eject the cartridge 13.

Unlike the form of FIG. 2, in this form the sealing means 18 between the push button 14' and the case 12 may include a boss 24' disposed on the push button 14' and clampingly bearing against the case 12.

The sealing means 18 between the push button 14' and the case 12 may include several bosses 24' disposed on the push button 14' and clampingly bearing against the case 12. By way of example, the sealing means 18 between the push button 14' and the case 12 may include two bosses 24'.

The sealing means 18 between the push button 14' and the case 12 may include an overmolded part 26' on the push button 14', for example made of elastomeric thermoplastic material, clampingly bearing against the case 12. The overmolded part 26' may include at least one boss(es) 24'.

Furthermore, in the variant, the case 12 comprises an axial tab 22 directed towards the longitudinal central axis A. The boss(es) of the push button 14' may clampingly bear against the axial tab 22. In addition, the boss(es) of the overmolded part 26' may clampingly bear against the axial tab 22. The axial tab 22 may be configured to cooperate with the sealing means 18 between the push button 14' and the case 12.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A refillable applicator for a cosmetic product, configured to include a cartridge movable between an initial position and an ejected position, the refillable applicator comprising:

- a housing case for the cartridge, the housing case defining a longitudinal central axis and including a portion extending towards the longitudinal central axis;
- a push button configured to eject the cartridge, the push button being movable between a rest position in which it is configured to allow the cartridge to be in the initial position in the case, and an ejection position in which it is configured to eject the cartridge out of the case; and sealing means between the push button and the portion of the case, when the push button is in at least one of the rest position and the ejection position.

2. The refillable applicator according to claim 1, wherein the push button comprises the sealing means between the push button and the case.

3. The refillable applicator according to claim 2, wherein the sealing means between the push button and the case comprises at least one boss disposed on the push button and clampingly bearing against the case.

4. The refillable applicator according to claim 2, wherein the sealing means between the push button and the case comprises a plurality of bosses disposed on the push button and clampingly bearing against the case.

5. The refillable applicator according to claim 1, wherein the sealing means between the push button and the case comprises an overmolded part on the push button clampingly bearing against the case.

6. The refillable applicator according to claim 5, wherein the overmolded part comprises an elastomeric thermoplastic material.

7. The refillable applicator according to claim 5, wherein the overmolded part comprises at least one boss.

8. The refillable applicator according to claim 5, wherein the overmolded part comprises a plurality of bosses.

9. The refillable applicator according to claim 1, wherein the portion is an axial tab directed towards the longitudinal central axis, the axial tab being configured to cooperate with the sealing means between the push button and the case.

10. The refillable applicator according to claim 1, wherein the case comprises the sealing means between the push button and the case.

11. The refillable applicator according to claim 1, wherein the sealing means between the push button and the case comprises at least one boss disposed on the case and clampingly bearing against the push button.

12. The refillable applicator according to claim 1, wherein the sealing means between the push button and the case comprises a plurality of bosses disposed on the case and clampingly bearing against the push button.

13. The refillable applicator according to claim 1, wherein the sealing means between the push button and the case comprises an overmolded part on the case, comprising at least one boss clampingly bearing against the push button.

14. The refillable applicator according to claim 1, wherein the sealing means between the push button and the case comprises an overmolded part on the case comprising a plurality of bosses clampingly bearing against the push button.

15. The refillable applicator according to claim 1, wherein the portion is an axial tab directed towards the longitudinal central axis, the axial tab comprising the sealing means between the push button and the case.

16. The refillable applicator according to claim 1, wherein the sealing means between the push button and the case comprises an O-ring disposed between the case and the push button.

17. The refillable applicator according to claim 1, further comprising a cartridge movable between an initial position in which the cartridge is fastened to the case, and an ejected position in which the cartridge is detached from the case.

18. The refillable applicator according to claim 17, wherein the cartridge comprises clipping means to fasten the cartridge to the case.

19. The refillable applicator according to claim 18, wherein the portion is an axial tab directed towards the longitudinal central axis, the axial tab comprising the sealing means between the push button and the case, and wherein the axial tab of the case comprises a cavity and the clipping means of the cartridge comprises a protrusion configured to cooperate with the cavity of the axial tab of the case, so as to retain the cartridge in the case.

20. The refillable applicator according to claim 17, wherein the cartridge comprises:

a ring having a recess configured to comprise a cosmetic product;

a cup movable in axial translation in the recess in order to bring the cosmetic product out of the recess or to bring the cosmetic product into the recess, the cup having a stem with a thread pitch; and an insert comprising a clipping means, the insert having a thread pitch complementary to the thread pitch of the stem of the cup, the ring being movable in rotation relative to the case and cooperating with the cup in order to drive it in axial translation.

* * * * *